US010253535B2

(12) United States Patent
Gruber et al.

(10) Patent No.: US 10,253,535 B2
(45) Date of Patent: Apr. 9, 2019

(54) VEHICLE DOOR SYSTEM WITH INFINITE DOOR CHECK

(71) Applicant: Multimatic, Inc., Markham (CA)

(72) Inventors: Rudolf Gruber, Uxbridge (CA); Andrew R. Daniels, Sharon (CA)

(73) Assignee: Multimatic Inc., Markham (CA)

( * ) Notice: Subject to any disclaimer, the term of this patent is extended or adjusted under 35 U.S.C. 154(b) by 54 days.

(21) Appl. No.: 15/528,424

(22) PCT Filed: Apr. 9, 2015

(86) PCT No.: PCT/US2015/025083

§ 371 (c)(1),
(2) Date: May 19, 2017

(87) PCT Pub. No.: WO2016/164024

PCT Pub. Date: Oct. 13, 2016

(65) Prior Publication Data

US 2017/0328097 A1 Nov. 16, 2017

(51) Int. Cl.

| | |
|---|---|
| ***E05C 17/00*** | (2006.01) |
| ***E05C 17/56*** | (2006.01) |
| ***E05F 15/70*** | (2015.01) |

(52) U.S. Cl.

CPC ..... *E05C 17/006* (2013.01); *E05C 17/003* (2013.01); *E05C 17/56* (2013.01);
(Continued)

(58) Field of Classification Search

CPC ..... E05C 17/006; E05C 15/70; E05C 17/003; E05C 17/56; E05Y 2201/232;
(Continued)

(56) References Cited

U.S. PATENT DOCUMENTS 5,074,010 A * 12/1991 Gignac ..... E05C 17/206 16/334
5,346,272 A 9/1994 Priest et al.
(Continued)

FOREIGN PATENT DOCUMENTS

DE 10200702679 A1 * 8/2008
DE 102007026796 8/2008
(Continued)

OTHER PUBLICATIONS

International Search Report for PCT/US2015/025083 dated Dec. 3, 2015.
(Continued)

*Primary Examiner* — Lori L Lyjak
(74) *Attorney, Agent, or Firm* — Carlson, Gaskey & Olds, P.C.

(57) ABSTRACT

An automotive door system includes a hinge supporting a door. A door check module interconnects to one of the vehicle and the door by a linkage assembly. An output shaft is connected to the linkage assembly and rotates relative to a door check module housing. The output shaft provides an output torque to check the door in a desired door position. A sensor detects rotation of the shaft and produces a signal in response thereto. A brake assembly includes a shaft member operatively connected to the output shaft. The brake assembly has a normally closed position in which the shaft member is grounded to the housing in a door check mode. The brake assembly includes an open position that corresponds to one of a door closing mode and a door opening mode. The brake assembly moves from the normally closed position to the open position in response to the signal.

17 Claims, 7 Drawing Sheets

(52) U.S. Cl.
CPC ..... *E05F 15/70* (2015.01); *E05Y 2201/232* (2013.01); *E05Y 2201/246* (2013.01); *E05Y 2201/26* (2013.01); *E05Y 2201/266* (2013.01); *E05Y 2201/462* (2013.01); *E05Y 2900/531* (2013.01)

(58) Field of Classification Search
CPC ..... E05Y 2201/246; E05Y 2201/26; E05Y 2201/266; E05Y 2201/462; E05Y 2900/531
See application file for complete search history.

(56) References Cited

U.S. PATENT DOCUMENTS

| | | | | |
|---|---|---|---|---|
| 7,438,346 | B1 * | 10/2008 | Breed | E05C 17/203 296/146.12 |
| 8,292,337 | B2 | 10/2012 | Chang | |
| 8,938,852 | B2 | 1/2015 | Kim | |
| 2008/0143139 | A1 | 6/2008 | Bauer et al. | |
| 2009/0051192 | A1 * | 2/2009 | Ewing | E05F 15/622 296/146.2 |
| 2011/0061199 | A1 | 3/2011 | Rauscher et al. | |
| 2013/0333159 | A1 * | 12/2013 | Hooton | E05C 17/203 16/84 |
| 2014/0096342 | A1 | 4/2014 | Kim | |
| 2015/0240548 | A1 | 8/2015 | Bendel et al. | |
| 2016/0032624 | A1 | 2/2016 | Bendel et al. | |

FOREIGN PATENT DOCUMENTS

| | | |
|---|---|---|
| EP | 0783067 | 7/1997 |
| JP | 2015183359 A | 10/2015 |

OTHER PUBLICATIONS

Preliminary Report on Patentability for PCT/US2015/025083 dated Apr. 5, 2017.
Japanese Office Action for Japanese Application No. 2017-525369 dated Jun. 15, 2018.

* cited by examiner

VEHICLE DOOR SYSTEM WITH INFINITE DOOR CHECK

BACKGROUND

This disclosure relates to a door check for a vehicle door, and more particularly, for a vehicle passenger door.

Passenger doors are conventionally held opened and closed using a door check. A passenger pushes a button or engages a handle, which unlatches the door enabling it to swing open. The door check is interconnected between the frame and door and includes detents that define discrete door open positions, which hold the door open. When the door is opened or closed the holding force of the detent is overcome.

A conventional door check only provides a few discrete door hold open positions that may not coincide with the most convenient door open angle for the passenger to ingress or egress the vehicle. Passive infinite door checks solutions such as U.S. Pat. No. 5,410,777 have been proposed to address this shortcoming. However even such a device can provide an inconsistent feel when the holding force of the detent is "released" depending on the attitude of the vehicle. For example, if the vehicle is parked on an incline, when released from a hold position, the door may feel as if it may suddenly close due to the weight of the door. A further shortcoming of the prior art is that door checks cannot be used to prevent the door hitting an obstacle when the door is swung open in a tight parking situation, which is desirable to prevent costly repair to the door.

SUMMARY

In one exemplary embodiment, an automotive door system includes a hinge that is configured to support a door. A door check module is configured to be interconnected to one of the vehicle and the door by a linkage assembly. The door check module includes a housing. An output shaft is connected to the linkage assembly and configured to be rotatable relative to the housing. The output shaft is configured to provide an output torque to check the door in a desired door position. A sensor is configured to detect rotation of the shaft and produce a signal in response to the detected rotation. A brake assembly includes a shaft member that is operatively connected to the output shaft. The brake assembly has a normally closed position in which the shaft member is grounded to the housing in a door check mode. The brake assembly includes an open position that corresponds to one of a door closing mode and a door opening mode. The brake assembly is configured to move from the normally closed position to the open position in response to the signal.

In a further embodiment of the above, a controller is in communication with the sensor and the brake assembly. The controller is configured to command the brake assembly to move from the normally closed position and release the shaft in response to the signal. The signal is indicative of slippage of the shaft member in the normally closed position. The controller is configured to command the brake assembly to the normally closed position in response to the signal falling below a threshold value and provide a holding torque in the desired door position.

In a further embodiment of any of the above, an obstacle sensor is in communication with the controller. The obstacle sensor is configured to detect an obstacle, and the controller commands the door to stop with the brake assembly in the normally closed position in response to the detected obstacle.

In a further embodiment of any of the above, a gearbox interconnects the output shaft and the shaft member. The gearbox multiplies the holding torque.

In a further embodiment of any of the above, the brake assembly is arranged between the gearbox and the sensor.

In a further embodiment of any of the above, the linkage assembly is configured to be interconnected to a door pillar and to transmit the output torque to the door pillar.

In a further embodiment of any of the above, the position sensor is integrated with the brake assembly. The position sensor is configured to detect rotation of the shaft member, which is indicative of rotation of the output shaft.

In a further embodiment of any of the above, the brake assembly includes a permanent magnet grounding the shaft member to the housing in the normally closed position. A coil is configured to overcome a magnetic flux of the permanent magnet to provide an open position that permits the shaft member to freely rotate relative to the housing.

In a further embodiment of any of the above, the coil is modulated to provide a desired release of the brake assembly corresponding to a desired door feel.

In a further embodiment of any of the above, the brake assembly includes a holding torque in the normally closed position, and the coil is configured to be modulated to decay the holding torque in relation to a pulse width modulation average voltage supplied to the coil.

In a further embodiment of any of the above, the controller is configured to reverse a polarity of current to the coil to supplement the magnetic flux in the normally closed position and is configured to increase the door arresting torque.

In a further embodiment of any of the above, an attitude sensor is in communication with the controller. The attitude sensor is configured to provide an attitude of the vehicle. The controller is configured to regulate the brake assembly in response to a signal from the attitude sensor.

In another exemplary embodiment, an infinite door check includes a housing. An output shaft is configured to be rotatable relative to the housing. The output shaft is configured to provide an output torque to check a door in a desired door position. A sensor is configured to detect rotation of the shaft and produce a signal in response to the detected rotation. A brake assembly includes a shaft member operatively connected to the output shaft. The brake assembly has a normally closed position in which the shaft member is grounded to the housing in a door check mode. The brake assembly includes an open position that corresponds to one of a door closing mode and a door opening mode. The brake assembly is configured to move from the normally closed position to the open position in response to the signal. The signal is indicative of slippage of the shaft member in the normally closed position.

In a further embodiment of any of the above, a gearbox interconnects the output shaft and the shaft member. The gearbox multiplies the holding torque.

In a further embodiment of any of the above, a linkage assembly interconnects to the output shaft. The linkage assembly is configured to transmit the output torque from the output shaft to a door pillar.

In a further embodiment of any of the above, the position sensor is integrated with the brake assembly. The position sensor is configured to detect rotation of the shaft member, which is indicative of rotation of the output shaft.

In a further embodiment of any of the above, the brake assembly includes a permanent magnet that grounds the shaft member to the housing in the normally closed position. A coil is configured to overcome a magnetic flux of the permanent magnet to provide an open position that permits the shaft member to freely rotate relative to the housing.

In a further embodiment of any of the above, a reverse polarity of current to the coil supplements the magnetic flux in the normally closed position and is configured to increase the door arresting torque.

In another exemplary embodiment, a method of checking a door includes the steps of holding a door in an open position with an electric brake assembly and manually pivoting the door in a direction about a hinge to provide a manual input. The manual input is detected and the electric brake assembly is released in response to the manual input.

In a further embodiment of any of the above, the detecting step includes back-driving a gearbox via an output shaft and detecting rotation of the output shaft.

In a further embodiment of any of the above, the detecting step includes indirectly sensing rotation of the output shaft by sensing rotation of an electric brake assembly shaft member.

In a further embodiment of any of the above, the manual input includes pushing or pulling on the door and exceeding a slip torque of a brake assembly that holds the door. The releasing step is performed in response to the slip torque.

In a further embodiment of any of the above, the method includes the step of detecting a door obstacle. The door holding step is performed in response to the detected obstacle.

In a further embodiment of any of the above, the door holding step includes reversing a polarity of current to a coil in the electric brake assembly to supplement the magnetic flux in a normally closed brake position and is configured to increase the door arresting torque.

BRIEF DESCRIPTION OF THE DRAWINGS

The disclosure can be further understood by reference to the following detailed description when considered in connection with the accompanying drawings wherein.

Figure 1A:
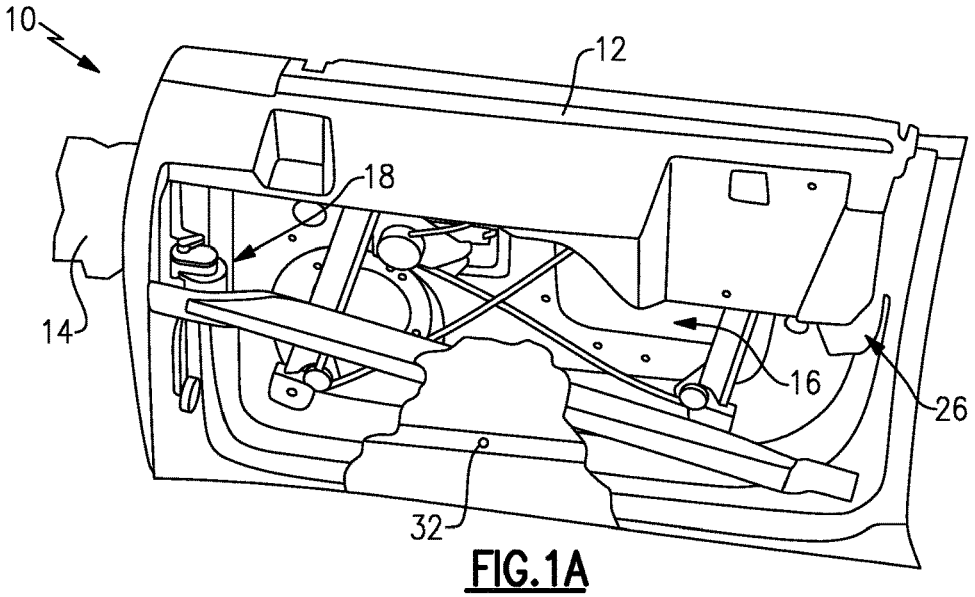
FIG. 1A is a perspective view of a vehicle door with an infinite door check mounted to a door pillar.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

A conventional automotive vehicle 10 (only a portion shown) typically includes multiple doors 12 (one shown) used for egress and ingress to the vehicle passenger compartment and/or cargo area. In the example, the door 12 is a passenger door. The door 12 is pivotally mounted by hinges 15 to a door pillar 14, such as an A-pillar or B-pillar, about which the door is movable between opened and closed positions. The door 12 has a cavity 16 that typically includes an impact intrusion beam, window regulator, and other devices. A door check module 18 is arranged within the cavity 16, although the door check module 18 can instead be arranged in the door pillar 14, if desired. Mounting the door check module 18 near the hinges 15 minimizes the impact on door inertia.

The door check module 18 is part of a door system 20 (FIG. 2) that holds the door 12 in an open position without the discrete detents typically found in conventional door checks. Instead the system 20 is capable of holding the door in an infinite number of open positions. Moreover, the system 20 can provide a consistent feel during release of the door regardless of vehicle attitude and be used to actively stop the door when an obstacle is detected in the swing path of the door using an obstacle detection sensor.

Figure 1B:
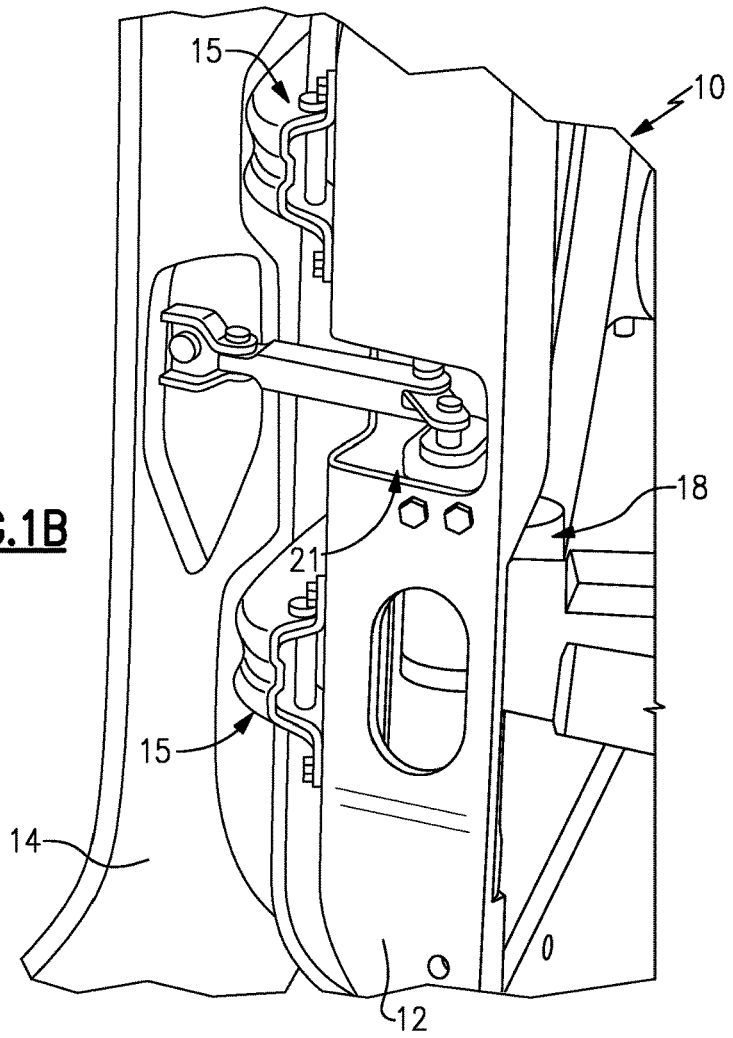
FIG. 1B is an enlarged perspective view of the door illustrating a linkage assembly of the infinite door check.

Referring to FIG. 1B, the door check module 18 is connected to the door pillar 14 by a linkage assembly 21. The linkage assembly 21 transmits the opening and closing forces to the door check module 18 and also stops and holds or only holds the door 12 open when desired.

Figure 2:
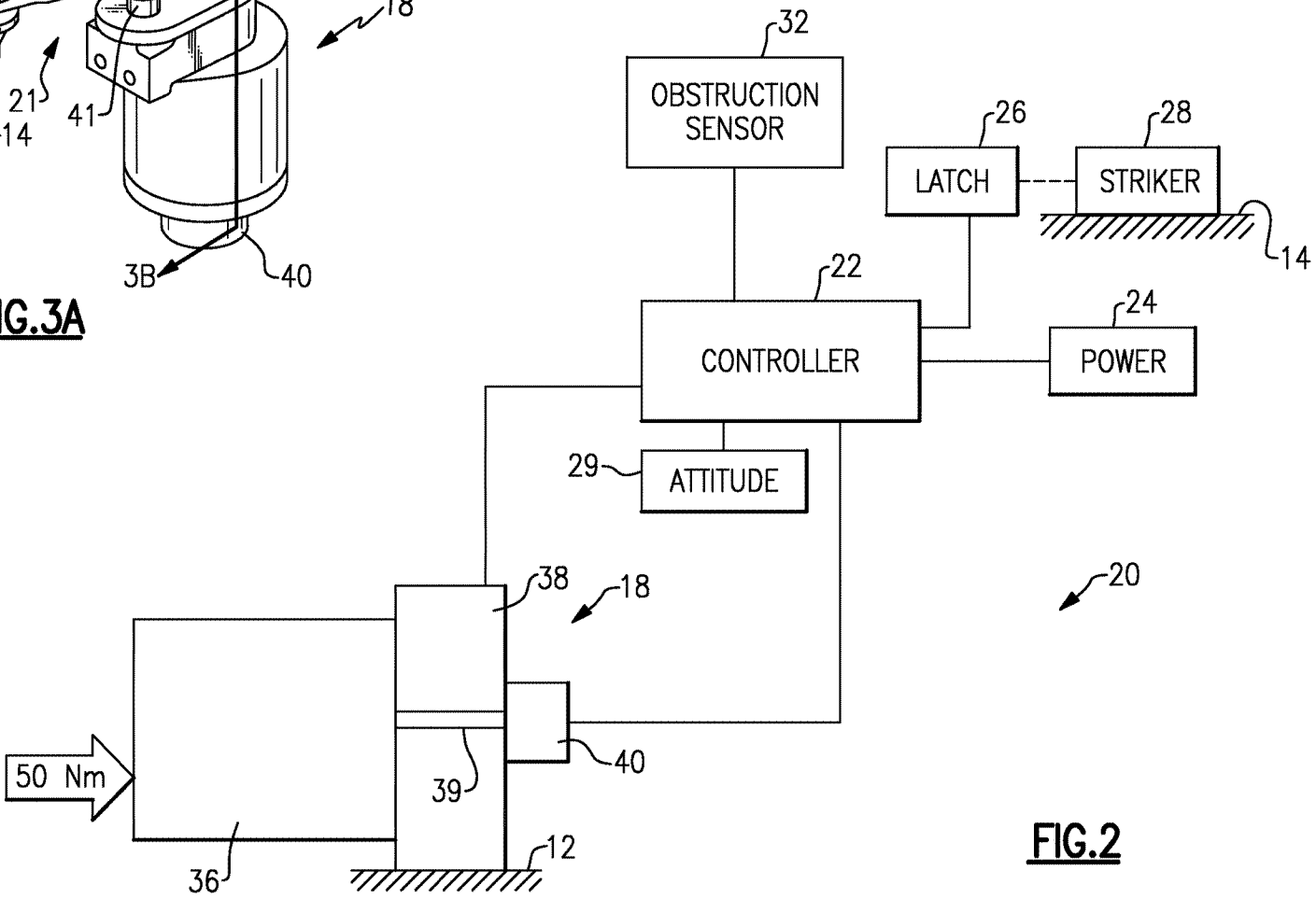
FIG. 2 is a schematic view of an example door system embodiment that uses the infinite door check.

Referring to FIG. 2, the system 20 includes a controller 22, or electronic control unit (ECU), that receives inputs from various components as well as sends command signals to the door check module 18 to selectively hold the door 12 open. A direct current (DC) power supply 24 is connected to the controller 22, which selectively provides electrical power to the door check module 18 in the form of commands. A latch 26, which is carried by the door 12 (FIG. 1A), is selectively coupled and decoupled to a striker 28 mounted to the door pillar 14. The latch 26 may be a power pull-in latch in communication with the controller 22, but a conventional mechanical latch may also be used. In one embodiment, the latch 26 includes a sensor that can communicate its open or closed state to the controller 22.

A vehicle attitude sensor 29 is in communication with the controller 22 and is used to detect the attitude of the vehicle, which is useful in controlling the motion of the door 12 when released by the door check module 18.

In one example, an obstruction sensor 32, such as an ultrasonic sensor, is in communication with the controller 22 and is used to generate a stop command if an obstruction is detected while the passenger is opening the door. The obstruction sensor 32 is mounted on the outer sheet metal of the door 12, for example. It should be understood that other sensors, such as optical sensors, can also be used and that other sensor locations, such as in the vehicle's door mirror base, can also be used to sense an obstruction.

Figure 3A:
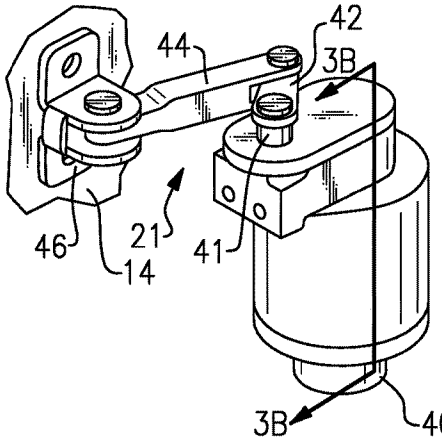
FIG. 3A is a perspective view of the infinite door check.
Figure 3B:
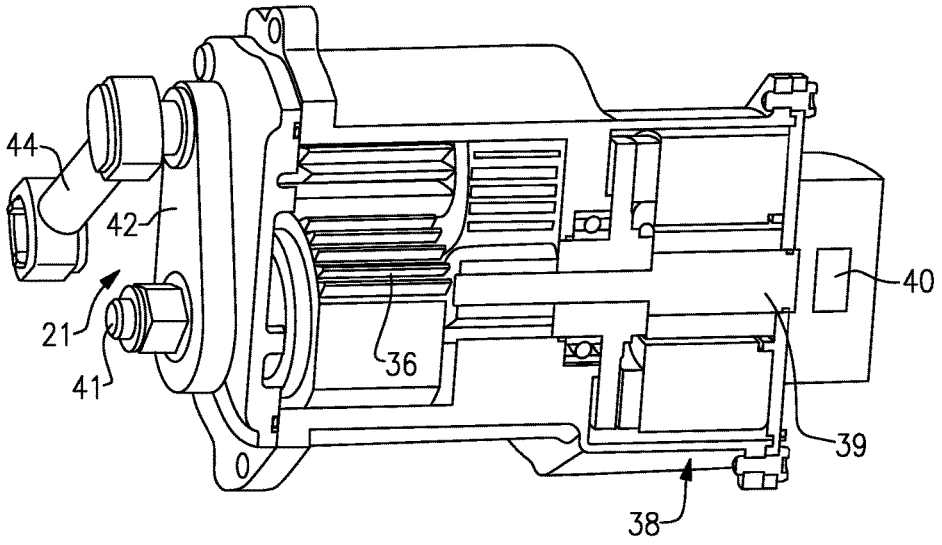
FIG. 3B is a cross-sectional view of the infinite door check taken along line 3B-3B of FIG. 3A.

Referring to FIGS. 2 and 3B, the door check module 18 includes a housing 33, which may be provided by one or more discrete structures secured to one another. A brake assembly 38 is grounded to the door 12 via the housing 33 and is selectively connected to a shaft member 39. One suitable brake assembly is available from Sinfonia NC, Model No. ERS-260L/FMF. This brake assembly 38 provides a relatively small amount of holding torque, for example, 8 Nm.

A gearbox 36 is used to multiply the holding torque provided by the brake assembly 38. In the example one gearbox is used, although more gearboxes may be used. The gearbox 36 is arranged within the housing 33 and is coupled to the brake assembly 38 by the shaft member 39. In one example, the gearbox 36 is a spur gear set providing a 6.25:1 reduction. Of course, it should be understood that other gear configurations and gear reductions may be provided. The total holding torque provided by the door check module 18 in the example embodiment is 50 Nm. Any torque applied to the brake assembly 38 above this threshold holding torque will cause the brake to slip, permitting the shaft member 39 to rotate.

The brake assembly 38 has a normally closed position in which the shaft member 39 is grounded to the housing 33 and prevented from rotating. The brake assembly 38 also includes an opened position corresponding to one of a door closing mode and a door opening mode. In the open position, the brake assembly 38 permits the shaft member 39 to rotate freely. Otherwise, the brake assembly 38 holds or "checks" the door 12 in its current position.

A position sensor 40, which is in communication with the controller 22, monitors the rotation of a component of the door check module 18, for example, the shaft member 39. In one example, the position sensor 40 is an integrated Hall effect sensor that detects the rotation of the shaft member 39.

Referring to FIG. 3A, an output shaft 41 of the gearbox 36 is coupled to the linkage assembly 21. A lever 42 is mounted to the output shaft 41 at one end and to a strap 44 at the other end. The strap 44 is pinned to a bracket 46 fastened to the door pillar 14. The linkage assembly 21 is designed to provide a holding torque of approximately the same as the desired door holding moment.

Figure 4:
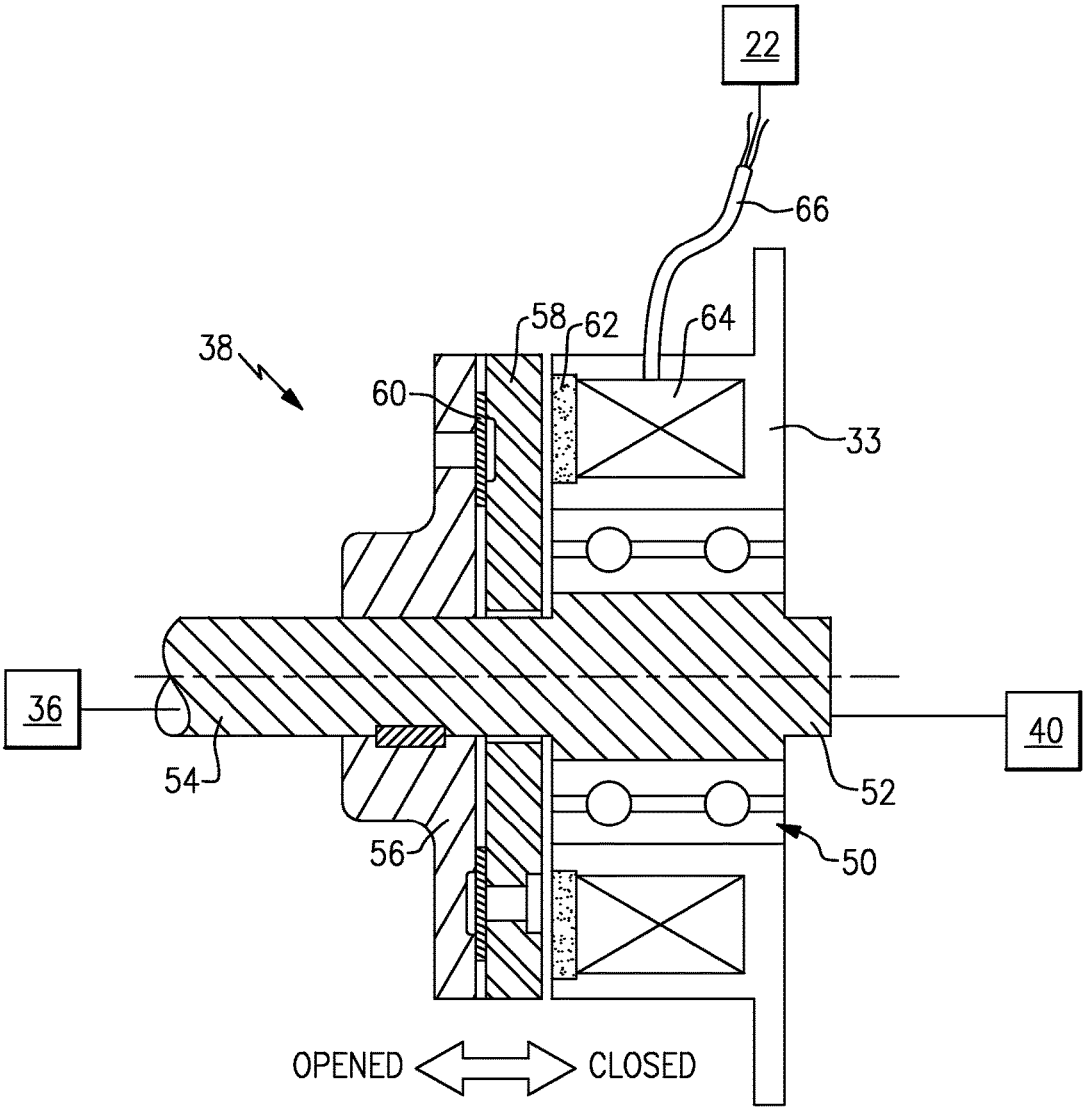
FIG. 4 is a cross-sectional view of a brake assembly for the infinite door check.

One example brake assembly 38 is shown in more detail in FIG. 4. The shaft member 39 is carried by a bearing 50 mounted to the housing 33. One end 52 communicates with the position sensor 40, and the other end 54 is connected to the gearbox 36. A drive ring 56 is secured to the end 54 and supports a permanent magnet 58. A spring 60, which may be a leaf spring in one example, is arranged between the drive ring 56 and permanent magnet 58 to bias the permanent magnet 58 away from the housing 33. A magnetic field generated by the permanent magnet 58 pulls the drive ring 56 with a much greater force than the spring 60 toward the housing 33. Friction material 62 is supported by the housing 33 and engages the permanent magnet 58 in the normally closed position to provide the torque at which the permanent magnet 58 will slip with respect to the housing 33, again, about 8 Nm.

A magnetic flux circuit, or coil 64, is arranged within the housing 33 and communicates with the controller 22 via wires 66. When energized with a defined polarity current, the coil 64 creates a counteracting magnetic flux to the permanent magnet 58 that is sufficient to overcome the magnetic field of the permanent magnet 58, thus allowing the spring 60 to move the permanent magnet 58 out of engagement with the friction material 62 to the position shown in FIG. 4. In this opened position, the shaft member 39 is permitted to rotate freely relative to the housing 33. The brake assembly components can be reconfigured in a manner different than described above and still provide desired selective brake hold torque.

The magnetic flux circuit, or coil 64 can also be powered in reverse polarity to add to the magnetic flux of the permanent magnet 58. This is advantageous when a stop command is generated by the controller 22 due to the detection of an obstruction. It has been shown that the addition coil generated magnetic flux increase the maximum holding torque by ~50%, for example. Therefore, the brake arresting torque increases to 12 Nm in such an example, which in turn provides a maximum arresting torque of 75 Nm.

Figure 5:
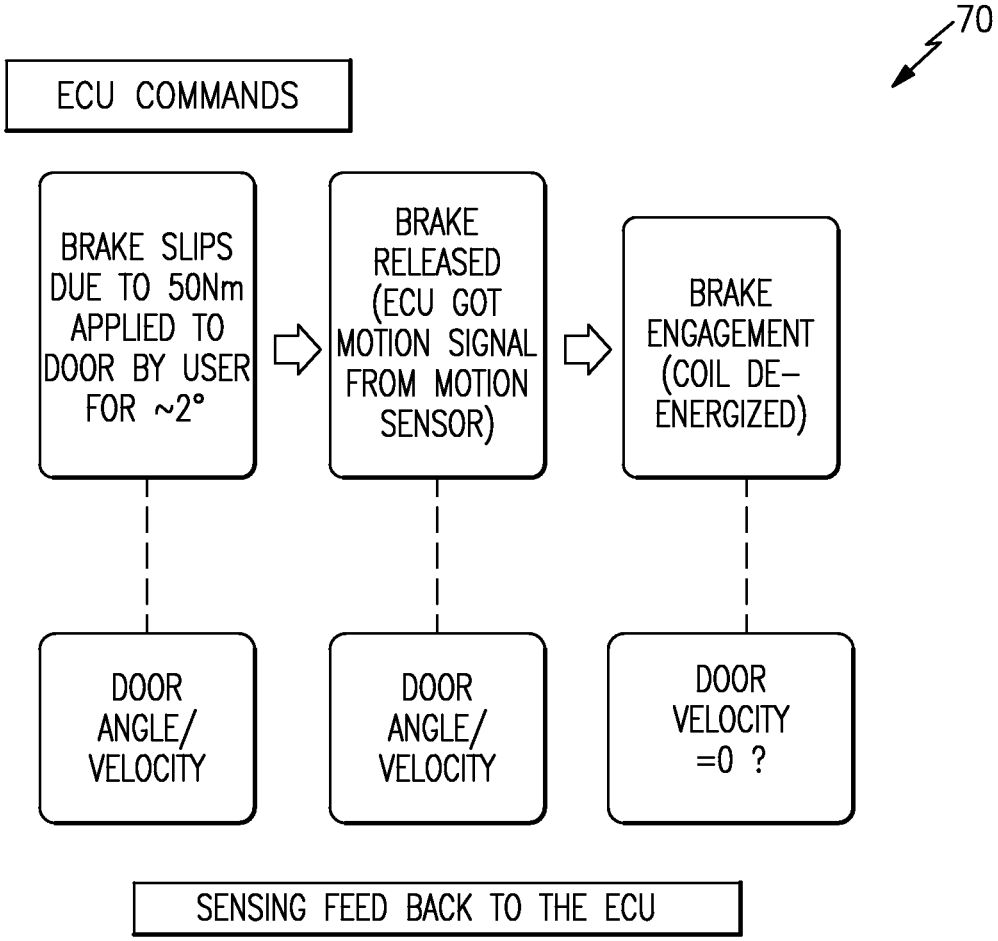
FIG. 5 is a flow chart depicting the operation of the infinite door check.

One example operating mode 70 is shown in FIG. 5. With the brake assembly 38 in the normally closed position, a holding torque is generated to maintain the door 12 in its current position. In the absence of slippage in the brake assembly 38, the door velocity is detected as zero via the position sensor 40.

The door 12 is pushed or pulled further open or closed by the user, which causes the linkage assembly 21 to rotate the output shaft 41 and back-drive the gearbox 36 and shaft member 39. When enough torque has been applied to slip the brake torque of the normally closed brake assembly 38 (in the example, 50 Nm), the shaft member 39 will rotate. An angular movement of the shaft member 39 is thus detected by the position sensor 40, which is indicative of rotation of the output shaft 41.

A detected threshold angular movement, for example, 2°, provides an input that is interpreted as a desired door motion command by the controller 22. Of course, other angular thresholds can be used, if desired. The position sensor 40 is used to detect the angular position of the door 12 as well as door velocity, which may be useful in controlling the brake assembly 38 based upon vehicle attitude.

Thus, in response to the input from the position sensor 40, the controller 22 will command the brake assembly 38 to release the shaft member 39, which will then rotate freely relative to the housing 33, permitting the door 12 to move. Once the shaft member 39 angular movement and/or velocity has been detected by the position sensor 40 to be about 0 (indicative of arrested door motion), the coil 64 is de-energized to reengage the brake assembly 38 and hold the door 12 in its current position.

Door motion is arrested at the fully open and fully closed positions. Additionally, the user can physically hold the door 12 in a desired position, preventing further movement of the door 12, which will be detected by the position sensor 40. The controller 22 then de-energizes the brake assembly 38, which will hold the door 12 where the user stopped the door 12, providing an "infinite" door check. That is, the door 12 can be held by the door check module 18 in any position rather than only in discrete detent positions. This feature is particular useful in tight parking situations where a door cannot be fully opened. The door can then be positioned in close proximity to an obstacle adjacent to the door and held by the user, at which point the brake assembly 38 will hold the door position, thus providing a maximum opening for the user to enter and exit the vehicle.

Figure 6:
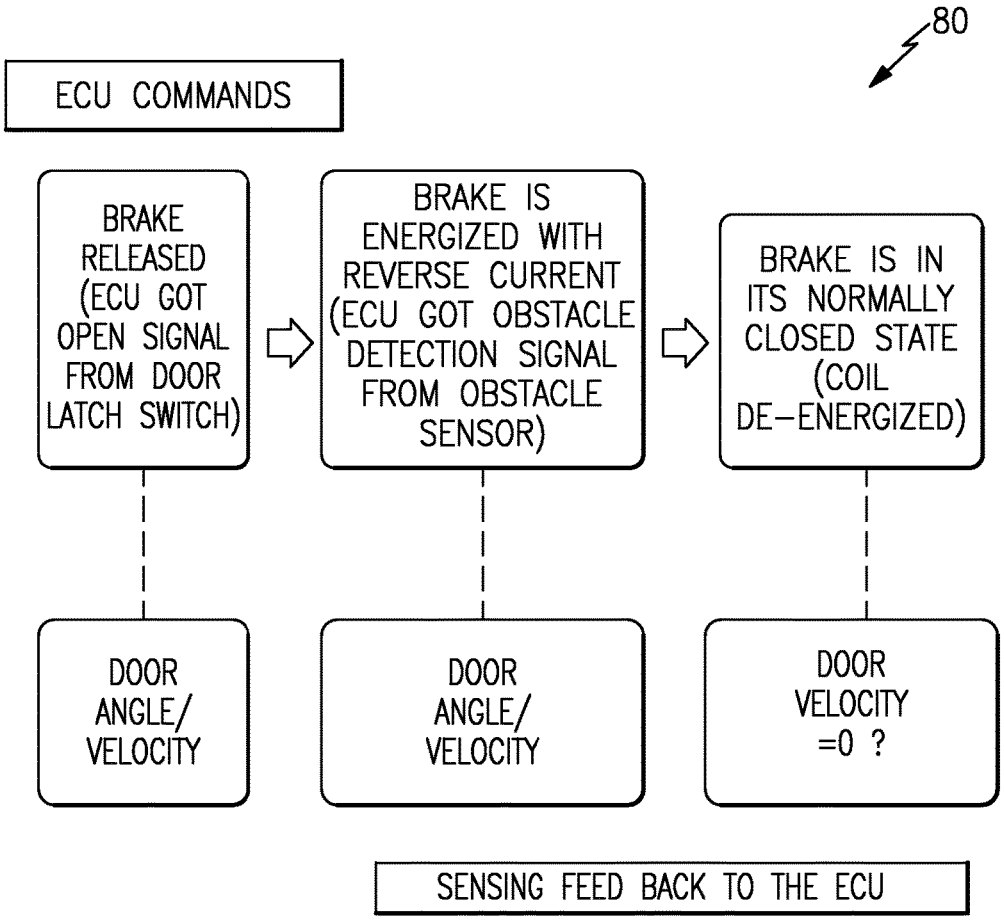
FIG. 6 is another flow chart depicting the operation of the infinite door check.

In a further example operating mode 80 is shown in FIG. 6 whereby a stop command is generated by the controller 22 due to an obstacle signal from obstacle sensor 32. This stop command includes a reverse polarity current to the brake that increase the brake holding torque to 12 Nm, which in turn results in a door arresting torque of 75 Nm by multiplication of the gearbox 36. The arresting torque ensures a rapid arresting of the door to prevent contact with the obstacle. When the door velocity is detected as zero via the position sensor 40 the reverse polarity current is dropped and the holding torque of the door check module 18 reverts to 50 Nm. The holding torque decay of the brake assembly 38 can be adjusted with pulse-width modulation of the coil 64. For example the nominal brake holding torque can be reduced to 6.4 Nm by applying approximately 4 V to the coil through pulse width modulation and thus provide a door check hold torque of approximately 40 Nm on level ground. In a further example, the vehicle attitude is detected with the attitude sensor 29 to vary the holding torque provided by the brake assembly 38 to provide a consistent holding torque regardless of vehicle incline or decline, which creates predictable door motion for the user. For example, a greater holding torque would be applied by the brake assembly 38 when the vehicle is on an incline than when the vehicle is on level ground.

Figure 7A:
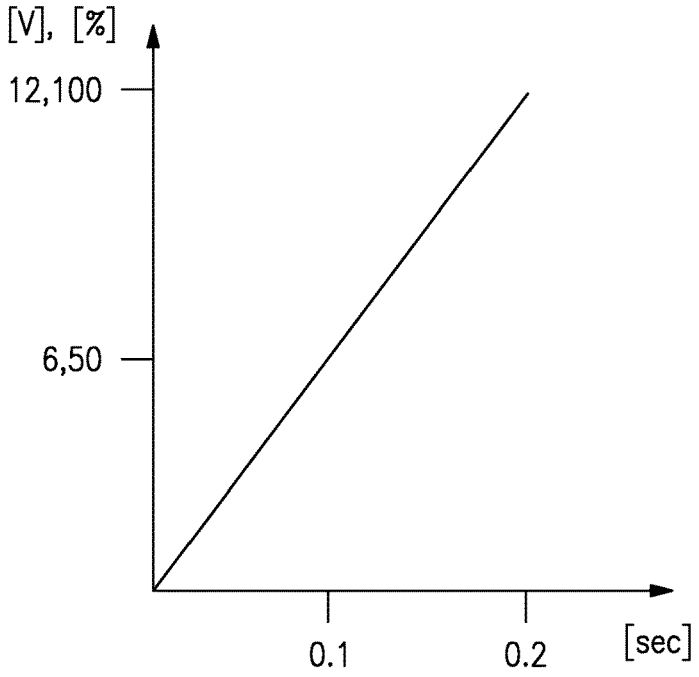
FIG. 7A is a graph illustrating brake assembly voltage versus time.
Figure 7B:
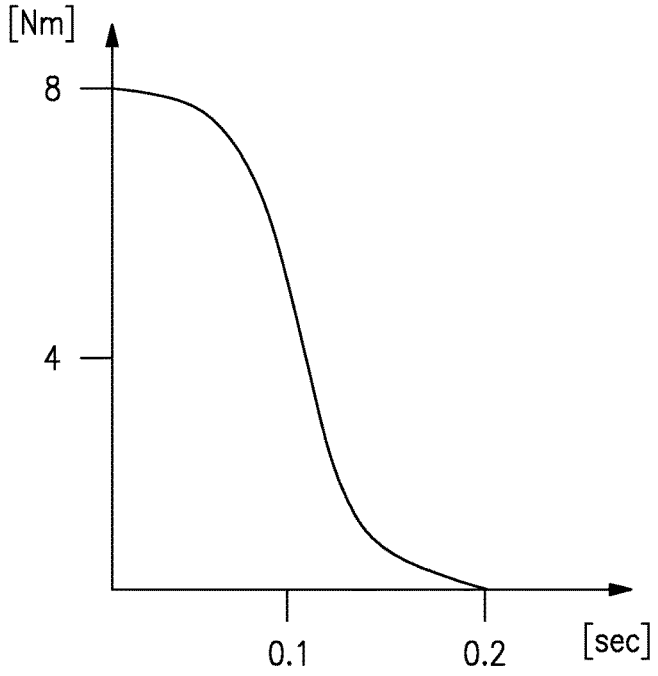
FIG. 7B is a graph illustrating brake assembly holding torque versus time according to the voltage-time relationship shown in FIG. 7A.

In a second example it may be desirable to "soft" release the brake assembly 38 to prevent an abrupt door movement that may cause an undesirable door feel for the customer. For example, 50 Nm of holding torque may produce a force in the linkage assembly 21 at the door pillar 14 of 700-900 N, which is capable of producing an audible sheet metal popping sound due to the sudden release of the stored hold moment energy. To address this potential undesired scenario, a soft release function is used, as shown in FIG. 7A, to ramp the pulse-width modulation signal from the controller 22 over, for example, 0.2 seconds, to full strength. As a result, the electrical counter field to the permanent magnetic field is slowly increased, thus reducing the brake hold torque from full strength to released, as shown in FIG. 7B, over the 0.2 seconds, which provides a "soft" release of the brake action. In the example, a gradual, linear increase in voltage provides a smooth, non-linear decay of holding torque. However, it should be understood that other voltage-torque-time relationships may be provided electrically and/or mechanically to provide a desired door feel.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. An automotive door system comprising:

a hinge configured to support a door of a vehicle;

a door check module configured to be interconnected to one of the vehicle and the door by a linkage assembly, the door check module includes:

a housing;

an output shaft connected to the linkage assembly and configured to be rotatable relative to the housing, the output shaft configured to provide an output torque to check the door in a desired door position;

a position sensor configured to detect rotation of a shaft member and produce a signal in response to the detected rotation; and a brake assembly includes the shaft member operatively connected to the output shaft, the brake assembly having a normally closed position in which the shaft member is grounded to the housing in a door check mode, the brake assembly includes an open position corresponding to one of a door closing mode and a door opening mode, the brake assembly configured to move from the normally closed position to the open position in response to the signal, wherein the brake assembly includes a permanent magnet grounding the shaft member to the housing in the normally closed position, and a coil is configured to overcome a magnetic flux of the permanent magnet to provide an open position that permits the shaft member to freely rotate relative to the housing;

a controller in communication with the position sensor and the brake assembly, the controller configured to command the brake assembly to move from the normally closed position and release the shaft member in response to the signal, the signal indicative of slippage of the shaft member in the normally closed position, and the controller configured to command the brake assembly to the normally closed position in response to the signal falling below a threshold value and provide a holding torque in the desired door position, wherein the controller is configured to reverse a polarity of current to the coil to supplement the magnetic flux in the normally closed position and is configured to increase the door arresting torque.

2. The automotive door system according to claim 1, comprising an obstacle sensor in communication with the controller, the obstacle sensor configured to detect an obstacle, and the controller commanding the door to stop with the brake assembly in the normally closed position in response to the detected obstacle.

3. The automotive door system according to claim 1, comprising a gearbox interconnecting the output shaft and the shaft member, wherein the gearbox multiplies the holding torque.

4. The automotive door system according to claim 3, wherein the brake assembly is arranged between the gearbox and the position sensor.

5. The automotive door system according to claim 1, wherein the linkage assembly is configured to be interconnected to a door pillar and to transmit the output torque to the door pillar.

6. The automotive door system according to claim 1, wherein the position sensor is integrated with the brake assembly, the position sensor configured to detect rotation of the shaft member, which is indicative of rotation of the output shaft.

7. The automotive door system according to claim 1, wherein the coil is modulated to provide a desired release of the brake assembly corresponding to a desired door feel.

8. The automotive door system according to claim 7, wherein the brake assembly includes a holding torque in the normally closed position, and the coil is configured to be modulated to decay the holding torque in relation to a pulse width modulation average voltage of the coil.

9. The automotive door system according to claim 1, comprising an attitude sensor in communication with the controller, the attitude sensor configured to provide an attitude of the vehicle, the controller configured to regulate the brake assembly hold torque in response to a signal from the attitude sensor.

10. An infinite door check comprising:

a housing;

an output shaft configured to be rotatable relative to the housing, the output shaft configured to provide an output torque to check a door in a desired door position;

a position sensor configured to detect rotation of a shaft member and produce a signal in response to the detected rotation; and a brake assembly includes the shaft member operatively connected to the output shaft, the brake assembly having a normally closed position in which the shaft member is grounded to the housing in a door check mode, the brake assembly includes an open position corresponding to one of a door closing mode and a door opening mode, the brake assembly configured to move from the normally closed position to the open position in response to the signal, the signal indicative of slippage of the shaft member in the normally closed position, wherein the brake assembly includes a permanent magnet grounding the shaft member to the housing in the normally closed position, and a coil is configured to overcome a magnetic flux of the permanent magnet to provide an open position that permits the shaft member to freely rotate relative to the housing, wherein a reverse polarity of current to the coil supplements the magnetic flux in the normally closed position and is configured to increase the door arresting torque.

11. The infinite door check according to claim 10, comprising a gearbox interconnecting the output shaft and the shaft member, wherein the gearbox multiplies the holding torque.

12. The infinite door check according to claim 10, comprising a linkage assembly interconnected to the output shaft, the linkage assembly configured to transmit the output torque from the output shaft to a door pillar.

13. An infinite door check comprising:

a housing;

an output shaft configured to be rotatable relative to the housing, the output shaft configured to provide an output torque to check a door in a desired door position;

a position sensor configured to detect rotation of a shaft member and produce a signal in response to the detected rotation; and a brake assembly includes the shaft member operatively connected to the output shaft, the brake assembly having a normally closed position in which the shaft member is grounded to the housing in a door check mode, the brake assembly includes an open position corresponding to one of a door closing mode and a door opening mode, the brake assembly configured to move from the normally closed position to the open position in response to the signal, the signal indicative of slippage of the shaft member in the normally closed position, wherein the position sensor is integrated with the brake assembly, the position sensor configured to detect rotation of the shaft member, which is indicative of rotation of the output shaft.

14. A method of checking a door comprising the steps of:

detecting a door obstacle;

holding a door in an open position with an electric brake assembly in response to the detected obstacle, wherein the door holding step includes reversing a polarity of current to a coil in the electric brake assembly to supplement a magnetic flux in a normally closed brake position to increase a door arresting torque;

manually pivoting the door in a direction about a hinge to provide a manual input;

detecting the manual input; and releasing the electric brake assembly in response to the manual input.

15. The method according to claim 14, wherein the detecting step includes back-driving a gearbox via an output shaft and detecting rotation of the output shaft.

16. The method according to claim 15, wherein the detecting step includes indirectly sensing rotation of the output shaft by sensing rotation of an electric brake assembly shaft member.

17. The method according to claim 14, wherein the manual input includes pushing or pulling on the door and exceeding a slip torque of the electric brake assembly that holds the door, the releasing step performed in response to the slip torque.

* * * * *